US009587899B2

(12) United States Patent
Frey

(10) Patent No.: US 9,587,899 B2
(45) Date of Patent: Mar. 7, 2017

(54) SHOOTING SUPPORT

(71) Applicant: Dan Frey, Millersburg, OH (US)

(72) Inventor: Dan Frey, Millersburg, OH (US)

( * ) Notice: Subject to any disclaimer, the term of this patent is extended or adjusted under 35 U.S.C. 154(b) by 0 days.

(21) Appl. No.: 14/738,987

(22) Filed: Jun. 15, 2015

(65) Prior Publication Data

US 2015/0362277 A1 Dec. 17, 2015

Related U.S. Application Data

(60) Provisional application No. 62/011,931, filed on Jun. 13, 2014.

(51) Int. Cl.
*F41A 23/06* (2006.01)
*F41B 5/14* (2006.01)

(52) U.S. Cl.
CPC ..... *F41A 23/06* (2013.01); *F41B 5/1453* (2013.01)

(58) Field of Classification Search
CPC ..... F41A 23/005; F41A 23/02; F41A 23/04; F41A 23/06; F41B 5/1453
USPC ..... 42/94; 124/1, 88, 89
See application file for complete search history.

(56) References Cited

U.S. PATENT DOCUMENTS 2,806,416 A * 9/1957 Jones, Jr. ..... F16M 13/04 224/908
4,967,497 A * 11/1990 Yakscoe ..... F16M 11/32 42/94
5,243,959 A 9/1993 Savage
5,351,867 A 10/1994 Vest
5,487,374 A * 1/1996 Herminath et al. ..... F41B 5/14 124/86
5,509,400 A 4/1996 Chalin
5,794,899 A * 8/1998 Tamllos ..... F16M 11/32 248/166
5,819,461 A * 10/1998 Killian ..... F16M 13/04 42/94
6,009,655 A * 1/2000 Austin ..... F41C 33/001 42/94
6,027,087 A * 2/2000 Lindemann ..... A63C 11/221 248/188.5
6,029,643 A 2/2000 Golfieri
6,138,970 A * 10/2000 Sohrt ..... F16M 11/10 248/278.1
6,244,556 B1 6/2001 Carrillo et al.
6,267,335 B1 7/2001 Barrett
6,637,708 B1 * 10/2003 Peterson ..... F41A 23/06 182/187
7,857,279 B2 12/2010 Krasnicki
8,695,581 B2 4/2014 Felt et al.
8,746,224 B2 6/2014 Khoshnood
2003/0038150 A1 * 2/2003 Williams ..... B60R 7/14 224/401
2005/0072414 A1 4/2005 Bryant
(Continued)

*Primary Examiner* — Bret Hayes
(74) *Attorney, Agent, or Firm* — Black, McCuskey, Souers & Arbaugh, LPA

(57) ABSTRACT

In accordance with an example embodiment, there is disclosed herein a shooting support for use with a bow or a firearm. The shooting support comprises a shaft having a plurality of telescoping segments, an upper end fitting pivotally mounted to the shaft, the upper end fitting having a plate, a lower end fitting pivotally mounted to the shaft, and a fixture coupled with the lower end fitting. The fixture is sized to receive a shoe of a user operating the shooting support.

5 Claims, 4 Drawing Sheets

(56) References Cited

U.S. PATENT DOCUMENTS

| | | | | |
|---|---|---|---|---|
| 2005/0207749 | A1* | 9/2005 | Barker | F16M 11/14 396/428 |
| 2013/0145671 | A1 | 6/2013 | Cavell | |
| 2014/0115940 | A1* | 5/2014 | Bonelli | F16M 11/14 42/94 |
| 2015/0354745 | A1* | 12/2015 | Tarnay | F16M 11/14 248/371 |

* cited by examiner

SHOOTING SUPPORT

CROSS REFERENCE TO RELATED APPLICATIONS

This application claims the benefit under 35 U.S.C. §119 (e) of U.S. Provisional Application No. 62/011,931 filed Jun. 13, 2014, the contents of which are hereby incorporated by reference.

TECHNICAL FIELD

The present disclosure relates generally to shooting devices and supports, including devices for shooting and hunting bows including compound bows.

BACKGROUND

Bows for shooting arrows, for target shooting or hunting, are typically held in the shooting position by full extension of one arm generally straight, e.g. parallel to the ground, and drawing of the bow wire away from the bow by the other hand. The bow supporting arm, wrist and hand must be held very steady for accurate shooting, and oppose the force of the drawn wire. Larger size bows with high wire tension require substantial strength to keep stable while aiming and shooting. Additional stabilization which does not otherwise interfere with the bow, bow wire or arrow would be very helpful to improve shooting accuracy.

BRIEF DESCRIPTION OF THE DRAWINGS

The accompanying drawings incorporated herein and forming a part of the specification illustrate the example embodiments.

OVERVIEW OF EXAMPLE EMBODIMENTS

Figure 1:
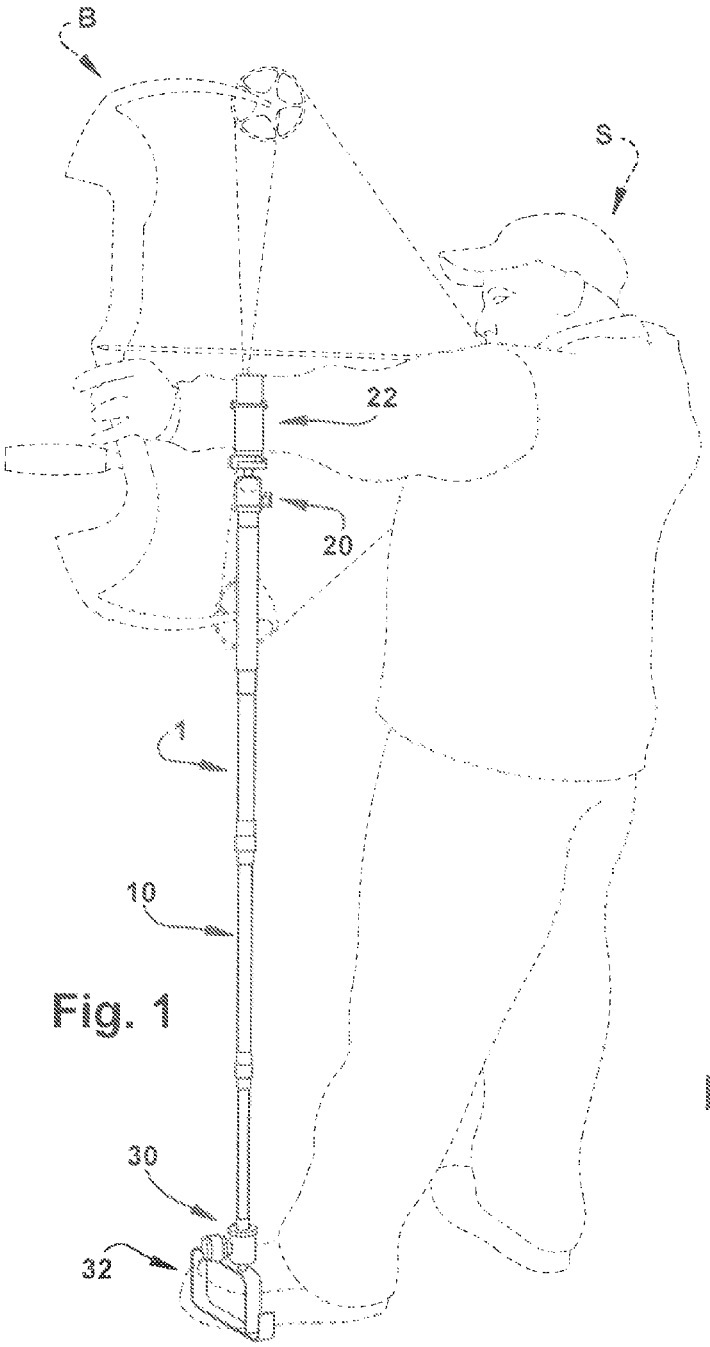
FIG. 1 is isometric side view of a shooting support.
Figure 2:
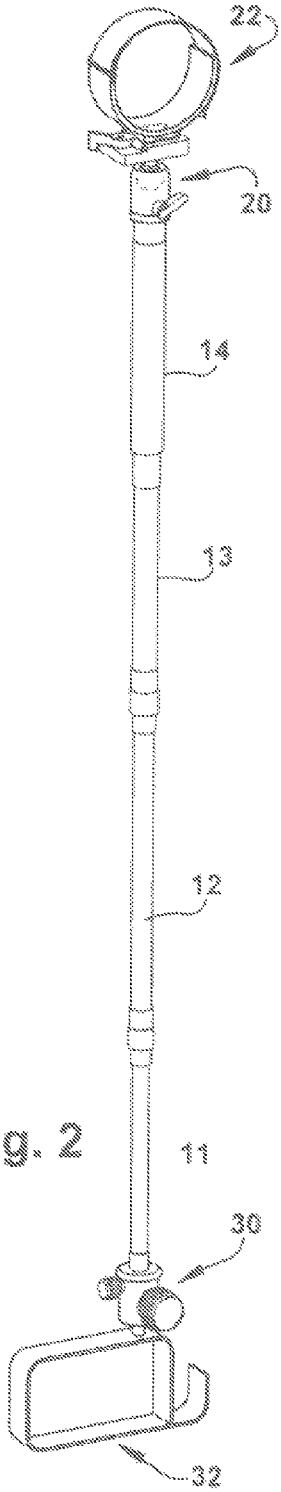
FIG. 2 is a isometric rear view of the shooting support.
Figure 3:
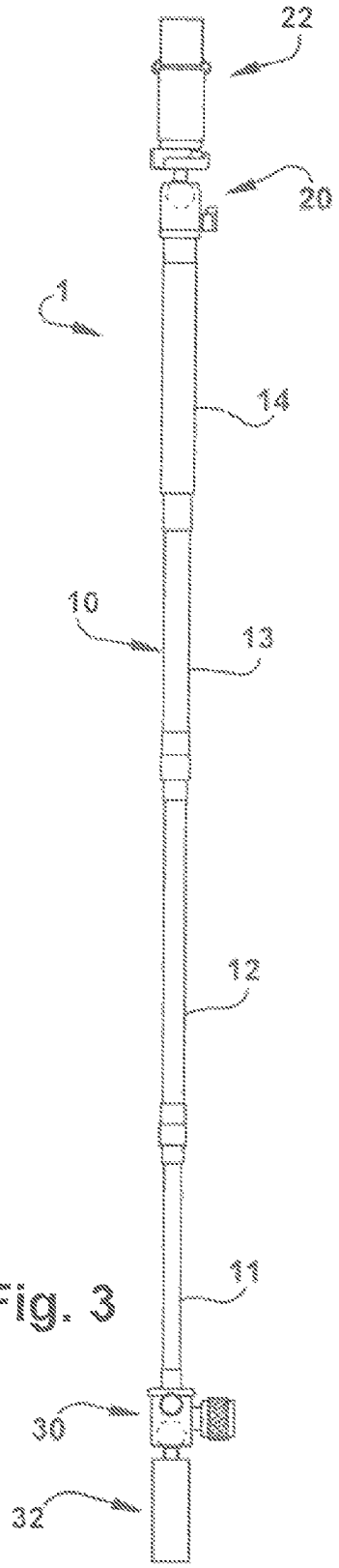
FIG. 3 is a side view of the shooting support.
Figure 4:
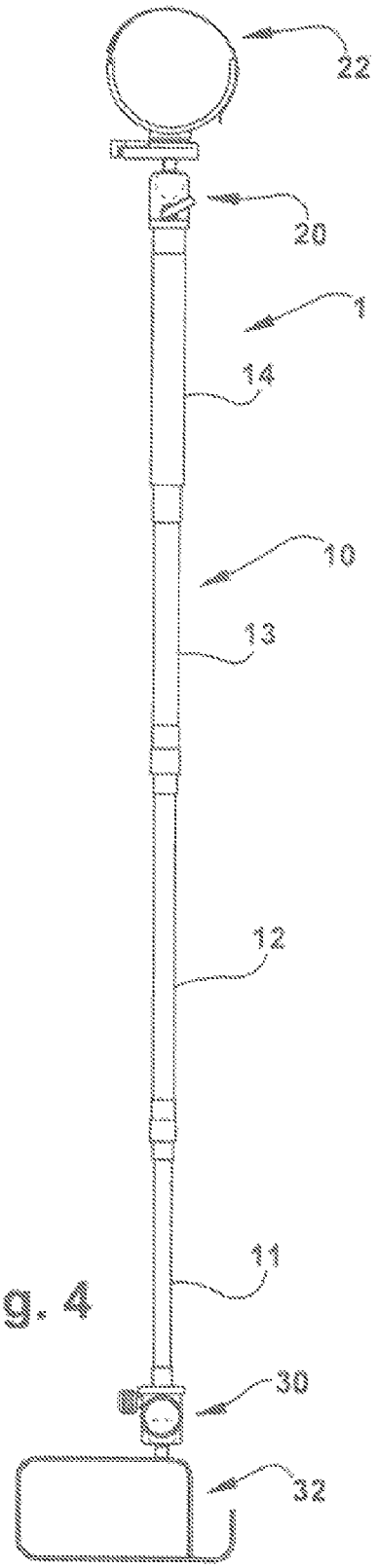
FIG. 4 is a rear view of the shooting support.
Figure 5:
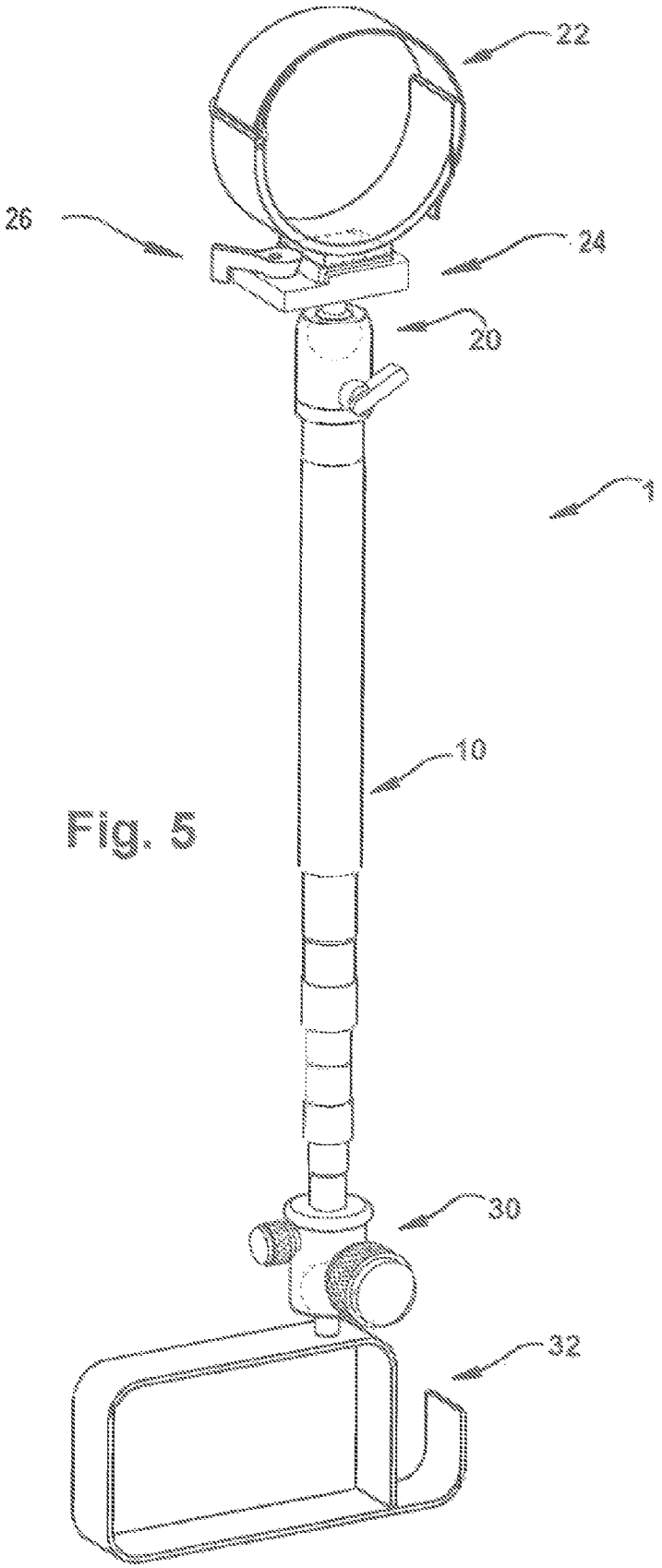
FIG. 5 is an isometric rear view of the shooting support illustrating several of the segments of the support in a collapsed position.

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein a shooting support for use with a bow or a firearm. The shooting support comprises a shaft having a plurality of telescoping segments, an upper end fitting pivotally mounted to the shaft, the upper end fitting having a plate, a lower end fitting pivotally mounted to the shaft, and a fixture coupled with the lower end fitting. The fixture is sized to receive a shoe of a user operating the shooting support.

DESCRIPTION OF EXAMPLE EMBODIMENTS

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

The present disclosure and related inventions provides an adjustable and articulated bow shooting support, a representative embodiment of which is indicated generally at 1 in the accompanying FIGS. 1-5, for supporting and stabilizing the shooting of a bow B by a shooter S. The bow support 1 is generally linear with a segmented shaft 10 which extends from a shooter's foot to the bow supporting arm of the shooter. The shaft 10 is preferably adjustable in length, for example by lockable telescoping engagement of individual shaft segments 11, 12, 13 and 14, for example by adjustable friction lock collars between each of the shaft segments. Each end of the shaft 10 is preferably pivotally mounted, for example by fitting 20 at an upper end and fitting 30 at a lower end. The fittings 20 and 30 may be any suitable articulatable and adjustable fitting or device which allows pivot motion of the shaft 10 relative to attachments or fixtures at either end, as further described.

The shaft 10 is secured to the shooter's arm by a strap 22, such as a flexible fabric or polymeric material strap with detachable fastening, or any other suitable means of attachment, which is preferably adjustable and which may be located at any desired position on the arm or wrist. The strap 22 is secured to fitting 20 via a quick connect plate 24 that can be released by lever 26 and thus oriented as desired relative to the end of the shaft 10.

The fitting 30 is connected to a fixture 32 configured for contact with the shooter's foot as illustrated, and may be of any suitable configuration such as for example to provide a surface for footwear sole to hold the fixture 32 in place and thereby secure the lower end of the shaft 10. The fittings 20 and 30 can be for example ball-and-socket type fittings which provide for infinite pivotal adjustment, or rod and receiver type which allow for infinite radial adjustment and friction adjustment. By adjustment of friction in the fitting 20 or fitting 30 or both, some movement of the fittings 20 and/or 30 may be allowed during use, such as for example during draw and at full draw. This is very advantageous for maintaining continuous aim at a moving target. Also, flexibility of the strap 22 and the strap connection to fitting 20 allows for some movement of the shooter's forearm.

In an example embodiment, the strap 20 is fastened to the quick connect plate 24 with a screw, enabling the strap to be removed from the quick connect plate. As illustrated, the strap 22 employs VELCRO for fastening, however, those skilled in the art should readily appreciate that any suitable technique may employed for securing the strap to the shooter S. For example, the strap may employ a buckle. The quick connect plate may be disconnected from fitting 20 by moving the lever 26 to an unlocked position. Upon re-insertion of the connect plate 24 with fitting 20, the lever 26 will automatically move to a locked position.

The same arrangement of the shooter with the bow support 1 and bow B can be in standing or sitting positions. The total length of the shaft 10 is adjusted accordingly by the telescoping connections of the shaft segments, as shown for example in FIG. 5. The collar connections between the telescoping shaft sections 11-14 can be adjusted to full lock or partial friction. At intermediate friction settings of one of more of the connections, the total length of the shaft 10 can be adjusted during aiming and shooting, including at full draw. This continuous length adjustment feature is also highly advantageous to achieving continuous stability and aiming.

The bow support is particularly well suited for use with compound type bows, as illustrated in phantom in FIG. 1, as the shaft 10 and arm fixture 20 do not interfere with any of the bow components or arrow. Also, the intersecting arrangement of the shaft 10 and the shooter's arm provides a very strong and stable support system for the bow which greatly improves aim and shooting accuracy.

Figure 6:
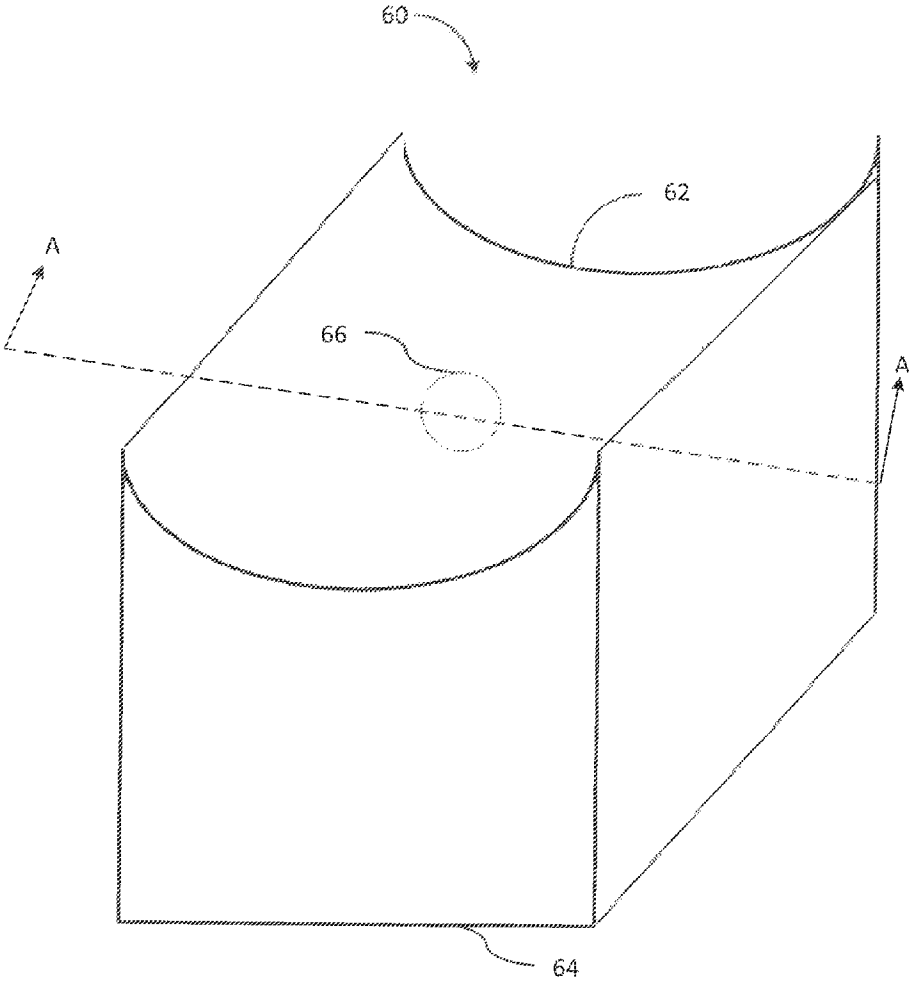
FIG. 6 is an isometric view of a gun mount for use with the shooting support.

FIG. 6 is an isometric view of a gun mount 60 for use with the shooting support 1. The gun mount 60 has a curved surface 62 fitted for the forearm of the firearm, and a bottom surface 64 attaches to a quick connect plate 24. As will be explained in more detail herein infra, the gun mount 60 comprises an aperture 66. In an example embodiment, the shooter may remove the quick connect plate 24 coupled with strap 22 from the upper mount 20 and attach a second quick connect plate to the surface 64 of the gun mount to couple with upper mount 20. In another example embodiment, the shooter may remove the quick connect plate 24 from the upper mount 20, remove the strap 22 from the quick connect plate, and re-connect the quick connect plate 24 to the upper mount 20.

Figure 7:
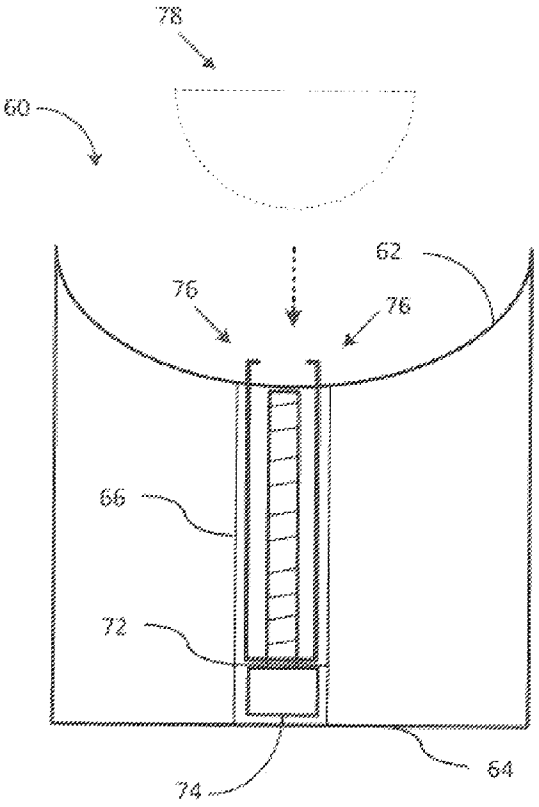
FIG. 7 is a cutaway view of the gun mount illustrated in FIG. 7 along lines A-A.

FIG. 7 is a cutaway view of the gun mount 60 illustrated in FIG. 7 along lines A-A. As can be observed in FIG. 7, a surface 72 inside aperture 66 allows for a bolt 74 to be coupled with pins 76. The pins 76 are operable to receive a sling stud 78 coupled with a firearm (not shown). The bolt can be manipulated to cause the pins 76 to close around the sling stud 78, thus securing the sling stud 78 to the gun mount 60.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

The invention claimed is:

1. An apparatus, comprising:

a shaft having a plurality of telescoping segments;

an adjustable friction lock collar between the plurality of telescoping segments operable to be set at an intermediate friction setting allowing for movement of at least one of the plurality of telescoping segments;

an upper end fitting pivotally mounted to the shaft, the upper end fitting having a lever;

a quick connect plate coupled with the upper end fitting;

a strap coupled with the quick connect plate;

a lower end fitting pivotally mounted to the shaft; and a fixture coupled with the lower end fitting wherein the quick connect plate is disconnected from the upper end fitting by moving the lever to an unlocked position; and wherein upon re-insertion of the quick connect plate with the upper end fitting, the lever automatically moves to a locked position.

2. The apparatus set forth in claim 1, wherein the upper fitting is a ball and socket fitting.

3. The apparatus set forth in claim 1, wherein the lower fitting is a ball and socket fitting.

4. The apparatus set forth in claim 1, wherein the adjustable friction lock collar is selectively adjustable between a full lock setting and a partial friction setting.

5. The apparatus set forth in claim 1, further comprising a gun mount operable to be coupled with the quick connect plate.

* * * * *